US007187392B2

(12) United States Patent
Ito

(10) Patent No.: US 7,187,392 B2
(45) Date of Patent: Mar. 6, 2007

(54) METHOD OF DRIVING ELECTRO-OPTICAL DEVICE, ELECTRO-OPTICAL DEVICE, AND ELECTRONIC APPARATUS

(75) Inventor: Akihiko Ito, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 361 days.

(21) Appl. No.: 10/460,392

(22) Filed: Jun. 13, 2003

(65) Prior Publication Data

US 2004/0013427 A1 Jan. 22, 2004

(30) Foreign Application Priority Data

Jun. 28, 2002 (JP) ..... 2002-190250
Apr. 18, 2003 (JP) ..... 2003-114352

(51) Int. Cl.
*G09G 5/10* (2006.01)

(52) U.S. Cl. ..... 345/690; 345/204; 345/205; 345/691; 345/692

(58) Field of Classification Search ..... 345/690, 345/204–205, 691, 692, 50, 55
See application file for complete search history.

(56) References Cited

U.S. PATENT DOCUMENTS 6,335,728 B1 * 1/2002 Kida et al. ..... 345/204
2002/0075287 A1 * 6/2002 Naka et al. ..... 345/690
2004/0036968 A1 2/2004 Ito

FOREIGN PATENT DOCUMENTS

| | | | |
|---|---|---|---|
| EP | 0 982 708 A1 | | 3/2000 |
| JP | 2001-100707 | * | 4/2001 |
| JP | A 2001-100707 | | 4/2001 |
| JP | A-2002-82653 | | 3/2002 |

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

The invention enhances gradation characteristics and realizes higher quality in a picture, in the context of subfield driving using a pixel provided therein with a memory.

A method of driving an electro-optical device that divides a predetermined period of time into a plurality of subfields SF5 to SF17, performs gradational display with a combination of subfields SF corresponding to gradation data, and provides a memory storing gradation data that is provided in each of a plurality of pixels is disclosed. In the method, at least part of gradation data is written in a memory provided in each of pixels. Further, data written in the memory are repeatedly read several times based on gradation signals defining each of the subfields SF, and a voltage having time density corresponding to read data is repeatedly applied to the pixels to thereby perform gradational display in accordance with gradation data.

7 Claims, 12 Drawing Sheets

FIG. 5

| FIRST SUBFIELD GROUP | SF1 | SF2 | SF3 | SF4 |
|---|---|---|---|---|
| SECOND SUBFIELD GROUP | SF5 | SF (3n) | SF (3n+1) | SF (3n+2) |
| P 0 | 0 | 0 | 1 | 0 |
| P 1 | 0 | 1 | 0 | 0 |
| P 2 | 0 | 0 | 0 | 1 |
| LSB(D2D1D0) MSB(D5D4D3) | | | | |
| 0 0 0 | 1 | 0 | 0 | 0 |
| 0 0 1 | 1 | 0 | 1 | 0 |
| 0 1 0 | 1 | 1 | 0 | 0 |
| 0 1 1 | 1 | 1 | 1 | 0 |
| 1 0 0 | 1 | 0 | 0 | 1 |
| 1 0 1 | 1 | 0 | 1 | 1 |
| 1 1 0 | 1 | 1 | 0 | 1 |
| 1 1 1 | 1 | 1 | 1 | 1 |

METHOD OF DRIVING ELECTRO-OPTICAL DEVICE, ELECTRO-OPTICAL DEVICE, AND ELECTRONIC APPARATUS

BACKGROUND OF THE INVENTION

1. Field of Invention

The present invention relates to a method of driving an electro-optical device, an electro-optical device and an electronic apparatus. More specifically, the invention relates to gradational control by subfield driving that uses a pixel provided therein with memories.

2. Description of Related Art

Subfield driving is a related art halftone display method. When subfield driving is used as a time axis modulation method, a predetermined period of time (for example, 1 frame as a display unit of a picture in a case of moving picture) is divided into a plurality of subfields, and pixels are driven by a combination of subfields corresponding to a gradation to be displayed. The gradation being displayed is determined in accordance with a ratio of the pixel-driving period of time as a part of a predetermined period of time. The ratio is specified by a combination of the subfields. In this method, like a amplitude modulation method, since there is no need to prepare voltages applied to electro-optical elements such as a liquid crystal, as much as the number of display gradations, the circuit scale of a driver to drive a data line can be reduced. Further, there is an advantage in that it can reduce or suppress deterioration of the display quality caused by the differences in characteristics of a D/A converter circuit or an OP amplifier or the like, or non-uniformity in various types of wire resistance or the like.

Japanese Unexamined Patent Application Publication No. 2002-082653 discloses a subfield driving in which pixels provided therein with memories are used. More particularly, each of the pixels include memory to store a plurality of bits of gradational data, and a pulse width control circuit connected to the rear stage of the memory in each of the pixels. The pulse width control circuit alternatively applies to a pixel electrode an on-voltage by which a pixel display state is set up as an on-state or an off-voltage by which a pixel display state is set up as an off-state, in accordance with data stored in a memory of the pixel. The ratio of applied time of the on-voltage that occupies 1 frame, i.e., the duty ratio is specified based on gradation data stored in a memory of the pixel. Once gradation data are written in the memory in any one of the pixels, gradational display continues in accordance with the data stored in the memory. Accordingly, in principle, with respect to a pixel in which gradation does not need to be changed, there is no need to perform writing of data again. In contrast, with respect to a pixel in which gradation needs to be changed, new gradation data are written in memories in the corresponding pixel whenever necessary.

SUMMARY OF THE INVENTION

If the subfield to set the display state of the pixels in the on-state is partially biased during a predetermined period of time (for example, 1 frame), it causes deterioration in gradation characteristics because differences between the practically displayed gradations are generated. In particular, it causes a remarkable problem in a case where a multiple-gradation is used.

Accordingly, the present invention provides a subfield driving that uses a pixel provided therein with memories, thereby enhancing gradation characteristics and implementing a higher definition picture.

To address or solve these and/or other problems, according to one aspect of the present invention, a method of driving an electro-optical device is provided that divides a predetermined period of time into a plurality of subfields, performs gradational display with a combination of subfields corresponding to gradation data, and provides memories in each of a plurality of pixels to store the gradation data. In the driving method, the first step of driving the electro-optical device includes: writing at least part of the gradation data in the memory, which is provided in each of the pixels. The second step includes: performing gradational display in accordance with the gradation data by repeatedly reading the data written in the memory a plurality of times based on a gradation signal defining each of the subfields, and also repeatedly applying to the pixels a voltage corresponding to the read data a plurality of times. It is preferred that the voltage applied to the pixels has a time density corresponding to the data read from the memory.

In the second step, it is preferred that the number of times the voltage is applied corresponds to the number of times data is read from the memory. Further, in the second step, the order of reading the data written in the memory may be changed in each of the repeated voltage applications.

According to a second aspect of the present invention, a method of driving an electro-optical device is provided that divides a predetermined period of time into a plurality of subfields, performs gradational display with a combination of subfields in accordance with gradation data, and provides memories in each of a plurality of pixels to store the gradation data. In the driving method, the first step includes: writing at least part of the gradation data in the memory provided in each of the pixels. The second step includes: performing gradational display corresponding to the gradation data by specifying a driving state of pixels in each of the subfields based on the data written in the memory and a gradation signal that defines each of the subfields, and also repeating a series of driving patterns of the pixels in a plurality of continuous subfields a plurality of times.

In the second step, it is preferred that the number of repetitions of the driving patterns corresponds to the number of repetitions of a series of transition patterns of the gradation signal in a plurality of continuous subfields. Further, in the second step, the order of the transition of the gradation signal may be changed in each of the repeated driving patterns.

According to the first or second aspect of the invention, in the first step, the writing of the gradation data may be performed in a first subfield. In this case, it is preferred that in the first subfield, a predetermined voltage is applied to the pixels independent of the gradation data written in the memory. Further, the writing of the gradation data in the memory in the first step may be performed over a plurality of subfields.

According to a third aspect of the invention, a method of driving an electro-optical device is provided that divides a predetermined period of time into a first subfield group and a second subfield group, performs gradational display with a combination of subfields corresponding to first data and second data, and provides a memory provided in each of pixels for storing the gradation data. The first data is data forming a part of gradation data. Further, the second data is data forming a part of gradation data and differing from the first data. In the driving method, in the first step, the first data are written in the memory provided in each of the pixels. In the second step, the first data written in the memory are read based on a first gradation signal defining each of the subfields forming the first subfield group, and a voltage corresponding to the first read data is applied to the pixels. In the third step, the second data are written in the memory. In the fourth step, the second data written in the memory are repeatedly read a plurality of times based on a second gradation signal defining each of the subfields forming the second subfield group, and a voltage corresponding to the second read data is repeatedly applied to the pixels a plurality of times. In the second step, it is preferred that the voltage applied to the pixels have a time density corresponding to the first read data, and in the fourth step, it is preferred that the voltage applied to the pixels has a time density corresponding to the second read data.

According to the third aspect of the invention, it is preferred that the entire weight of the second subfield group is larger than that of the first subfield group. In this case, it is preferred that the driving state of the pixel in each of the subfields forming the first subfield group is specified to correspond to lower data in the gradation data, and the driving state of the pixel in each of the subfields forming the second subfield group is specified to correspond to upper data of the gradation data.

Further, in the third aspect of the invention, the writing of the first data in the first step may be performed in the first subfield in the first subfield group, and the writing of the second data in the third step may be performed in the first subfield in the second subfield group. Further, writing of the first data in the first step and writing of the second data in the third step may be performed in the first subfield in the first subfield group. Further, the writing of the first data in the first step and writing of the second data in the third step may be performed in the first subfield in the second subfield group.

In this case, in the first subfield, it is preferred that a predetermined voltage is applied to the pixel regardless of whether the first data or the second data is written in the memory. Meanwhile, writing of the first data in the first step may be performed over the plurality of subfields forming the first subfield group, and writing of the second data in the third step may be performed over the plurality of subfields forming the second subfield group. Further, in the third aspect of the invention, voltages applied to the pixels may include at least an on-voltage to set the display state of the pixels in the on-state and an off-voltage to set the display state of the pixels in the off-state.

Further, the third aspect of the invention may further include a second operational mode that may be different from the first operational mode in which the first step to the fourth step are performed. The second operational mode includes a fifth step of writing in the memory second gradation data having a number of bits less than in the gradation data; and a sixth step of reading the second gradation data written in the memory, and also applying to the pixel a voltage having a time density corresponding to the second read gradation data and a gradation signal defining each subfield in the second operational mode.

According to a fourth aspect of the present invention, an electro-optical device is provided that divides a predetermined period of time into a plurality of subfields and performs gradation display with a combination of subfields corresponding to gradation data. The electro-optical device includes: a display unit, a scanning-line driving circuit, a data-line driving circuit, and a gradation-signal generating circuit. The display unit has a plurality of pixels provided at intersections of a plurality of scanning lines and a plurality of data lines, and each of the pixels includes: a pixel electrode, a memory to store at least part of the gradation data, and a pulse width generating circuit. The scanning-line driving circuit selects a scanning line corresponding to a pixel in which data is to be written. The data-line driving circuit writes data in the memory provided in a pixel to be written, through the data line corresponding to the pixel in which data is to be written while the scanning line is selected by the scanning-line driving circuit. The gradation-signal generating circuit generates a gradation signal defining each of the subfields. Further, the pulse width generating circuit repeatedly reads data written in the memory a plurality of times and repeatedly applies to the gradational electrodes a voltage corresponding to the read data a plurality of times, based on the gradation signal, thereby allowing a gradation corresponding to the gradation data to be displayed on the pixel. It is preferred that a voltage applied to the pixel may have a time density corresponding to the data read from the memory.

In the fourth aspect of the invention, it is preferred that the gradation-signal generating circuit repeatedly outputs a series of transition patterns of the gradation signal in a plurality of continuous subfields a plurality of times. In this case, the pulse width modulation circuit repeatedly reads the data written in the memory in accordance with the number of repetitions of the transition patterns of the gradation signal a plurality of times. Further, it is preferred that the pulse width modulation circuit repeatedly apply voltage to the pixel in accordance with the number of times that data from the memory are read.

Further, in the fourth aspect of the invention, the gradation-signal generating circuit may change the order of transition of the gradation signal in each of the repeated transition patterns to further enhance the gradation characteristics.

Further, in the fourth aspect of the invention, the scanning-line driving circuit may sequentially select the scanning lines in the first subfield of the subfield group, and the data-line driving circuit may perform writing of data in the memory in cooperation with the scanning-line driving circuit in the first subfield. In this case, it is preferred that the pulse width modulation circuit applies a predetermined voltage to the pixel electrode independent of the data written in the memory in the first subfield. Further, the scanning-line driving circuit may sequentially select the scanning lines over a plurality of subfields of the subfield group, and the data-line driving circuit may perform writing of data in the memory in cooperation with the scanning-line driving circuit in the plurality of subfields. In this case, it is preferred that the gradation-signal generating circuit includes a gradation signal shift circuit to generate a plurality of shifted gradational signals delayed in a transition timing of the gradation signal, in accordance with the selection period of each of the scanning lines.

Further, in the fourth aspect of the invention, the pulse width generating circuit may apply to the pixel electrode at least an on-voltage to set the display state of the pixels in an on-state or an off-voltage to set the display state of the pixels in the off-state.

A fifth aspect of the invention provides an electronic apparatus having an electro-optical device as described above according to the fourth aspect of the invention.

According to a sixth aspect of the invention, a method of driving an electro-optical device is provided that divides a predetermined period of time into a plurality of subfields, performs gradational display with a combination of subfields corresponding to gradation data, and provides memories to store gradation data that are provided in each of a plurality of pixels. The method includes: writing at least part of the gradation data in the memory provided in each of the pixels, and performing gradational display in response to the gradation data by repeatedly reading the data written in the memory a plurality of times based on a gradation signal defining each of the subfields, and also repeatedly applying to the pixels a current corresponding to the read data a plurality of times.

According to a seventh aspect of the invention, a method of driving an electro-optical device is provided that divides a predetermined period of time into a first subfield group and a second subfield group, performs gradational display with a combination of subfields corresponding to first data forming a part of gradation data and second data forming a part of the gradation data and differing from the first data, and provides a memory in each of a plurality of pixels to store the gradation data. The method includes: writing the first data in a memory provided in each of pixels, reading the first data written in the memory based on a first gradation signal defining each of the subfields forming the first subfield group, and also applying a current corresponding to the first read data to the pixels, writing the second data in the memory, and repeatedly reading the second data written in the memory based on a second gradation signal defining each of the subfields forming the second subfield group a plurality of times, and also repeatedly applying a current corresponding to the second read data to the pixels a plurality of times.

BRIEF DESCRIPTION OF THE DRAWINGS

FIG. 5 is a truth table of pulse signals output from a decoder;

DETAILED DESCRIPTION OF PREFERRED EMBODIMENTS

First Exemplary Embodiment

Figure 1:
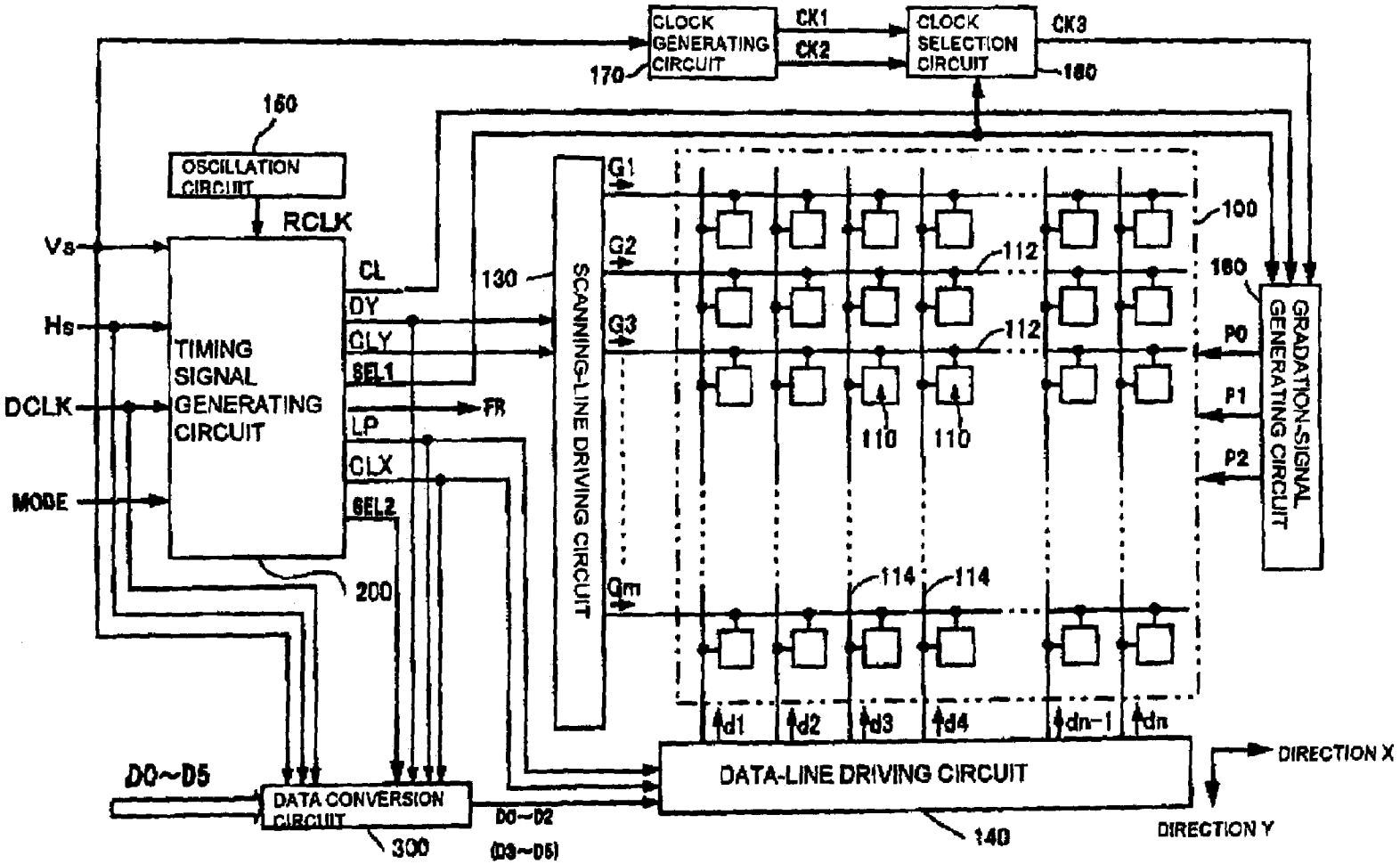
FIG. 1 is a schematic of an electro-optical device according to a first exemplary embodiment of the present invention.

FIG. 1 is a schematic of an electro-optical device according to an exemplary embodiment of the present invention. The display unit 100 includes m scanning lines 112 extended in an X direction (row direction) respectively, and n data lines 114 extended in a Y direction (column direction) respectively. The pixels 110 are disposed at intersections of the scanning lines 112 and the data lines 114, and the display unit 100 is configured such that they are arranged in a matrix shape. Further, the one data line 114 (as shown) is practically formed of a set of a plurality of data lines, and each of the pixels 110 is provided therein with the pixel memories storing gradation data. The detailed structure of the pixel 110 including these points is explained below.

The timing signal generating circuit 200 is supplied with a vertical synchronous signal Vs, a horizontal synchronous signal Hs, a dot clock signal DCLK of input gradation data D0 to D5, and an external signal called a mode signal MODE, by a host device (not shown). The mode signal MODE is a signal indicating the number of display gradations as any one out of a first operational mode having large number of display gradation or a second operational mode having the number of display gradation that is less than in the first mode. The first operational mode is, for example, a mode proper to a moving picture display having large number of display gradation. Further, the second operational mode is a mode proper to a still picture display having small number of display gradation, for example, called a character display, and its power consumption is low when compared with the first operational mode. In this exemplary embodiment, as an example, the number of gradation of the first operation mode is set up as 64 and the number of gradation of the second operation mode is set up as 8, which is less than that of the first operational mode. The oscillation circuit 150 generates a basic clock RCLK of read timing to supply it to the timing signal generating circuit 200.

The timing signal generating circuit 200 generates various types of internal signals including an alternating current conversion signal FR, a start pulse DY, a clock signal CLY, a latch pulse LP, a clock signal CLX, selection signals SEL1, SEL2, etc. based on the external signals Vs, Hs, DCLK, MODE. The alternating signal FR is a signal that its polarity is inverted every 1 frame or periodically. The start pulse DY is a pulse signal that is output at an opening time of each subfield SF that will be described later. The pulse DY controls the change of each of the subfields SF. The clock signal CLY defines the horizontal scanning period of time (1 H) at a scanning side (Y side).

The latch pulse LP is a pulse signal that is output in the first time of the horizontal scanning period of time. The latch pulse signal LP is output, during the level transition of the clock signal CLY, that is, during the clock signal CLY being leveled up and leveled down. The clock signal CLX is a dot clock signal for writing data in the pixels 110 (memories in the pixels as an accurate expression). The first selection signal SEL1 is a signal to select any one of clocks CK1, CK2 that are used as a base clock CK3 when the gradation signals P0 to P2 are generated. The second selection signal SEL2 is a signal to select a part of the 6-bit input gradation data D0 to D5.

The scanning-line driving circuit 130 transmits the start pulse DY, which is supplied for the first time of the respective subfield SF, in accordance with the clock signal CLY, and sequentially and exclusively supplies scanning signals G1, G2, G3, . . . and Gm to each of the scanning lines 112.

By doing so, the scanning-line driving circuit 130 performs a line sequential scanning of the scanning line 112, for example, sequentially selects the scanning line 112 one at a time from the highest scanning line 112 toward the lowest scanning line 112, as shown in the same drawing.

The data conversion circuit 300 stores in a frame memory temporarily the gradation data D0 to D5 of 6 bits that are input from a host device. Furthermore, the data conversion circuit 300 selectively reads at a proper timing any one of low-order 3 bits data D0 to D2 or high-order 3 bits data D3 to D5, from the frame memory, to output it to the data-line driving circuit 140. Whether which of the 3 bits gradation data D0 to D2 and D3 to D5 should be output is instructed by the second selection signal SEL2. That is, in a case where the selection signal SEL2 is a L level, the low-order 3 bits of gradation data D0 to D2 are output. In a case where this is a H level, the high-order 3 bits of gradation data D3 to D5 are output.

A level state of the second selection signal SEL2 varies with the operational mode. In a case where the first operational mode is instructed by the mode signal MODE, the second selection signal SEL2 is set up as a L level only during a predetermined period of time t1 to be changed to a H level, and the H level is maintained only during the a predetermined period of time t2. Accordingly, only the low-order data D0 to D2 out of the input gradation data D0 to D5 are read from a frame memory during the first half of the period of time t1, and the read data D0 to D2 are output to the data-line driving circuit 140. The high-order data D3 to D5 stored in the frame memory are read during the second half of the period of time t2 following the first half of the period of time t1, and the read data D3 to D5 are output to the data-line driving circuit 140. Here, in a case where the second operational mode is instructed by the mode signal MODE, the second selection signal SEL2 remains as a H level. Accordingly, in this case, only the high-order data D3 to D5 are output. Further, the first half of the period of time t1 corresponds to the total period of time of the first subfield group, which is described below, the second half of the period of time t2 corresponds to the total period of time of the second subfield group, which is described below. The total period of time of the first half of the period of time t1 and the second half of the period of time t2 corresponds to a 1 frame.

The data-line driving circuit 140 simultaneously performs a simultaneous output to pixel rows to write current data and a dot sequential latch of data concerning the pixel rows to write data during the following 1H, in the 1 horizontal scanning period of time 1H. During any horizontal scanning period of time, the data the number of which is corresponding to the number of data lines 114 is sequentially latched. During the following horizontal scanning period of time, the latched data are simultaneously output as the data signals d1, d2, d3, . . . and dn to each of the data lines 114. In the case of the first operational mode, the latch-output of the lower data D0 to D2 are completed and then the latch-output of the high-order data D3 to D5 are started, within a 1 frame.

The data-line driving circuit 140 includes 3-divisional circuit system formed with an X shift register, a first latch circuit and a second latch circuit (by which it becomes possible to latch-output the 3 bits gradation data D0 to D2 (or D3 to D5). In view of processing system of 1 bit serial data, the X shift register transmits the latch pulse LP, which is first supplied during the 1 horizontal scanning period of time, in response to the clock signal CLX, and sequentially and exclusively supplies it as the latch signals S1, S2, S3, . . . and Sn. The first latch circuit sequentially latches data of 1 bit in response to the falling of the latch signals S1, S2, S3, . . . and Sn. The second latch circuit latches 1-bit data latched by the first latch circuit, in response to the falling of the latch pulse LP, and in parallel outputs it to the data lines 114 as a H level or a L level of 2-value data d1, d2, d3, . . . and dn.

In this exemplary embodiment, the pixel electrode of each of the pixels 110 is directly supplied not with a voltage corresponding to data supplied to data lines 114, but with an off-voltage Voff or an on-voltage Von supplied to other system that is different from that. The data supplied to the data lines 114 are used to select the voltages Voff, Von that are applied to the pixel electrode. Meanwhile, the counter electrode facing the pixel electrode is applied with a voltage LCOM. To drive liquid crystal with alternating current, the voltage LCOM is set up as a voltage (for example, 0 [V], 3[V]) that is every frame or periodically inverted in its polarity, the off-voltage Voff as a same phase of voltage (for example, 0[V], 3[V]), and the on-voltage Von as a reverse phase of voltage (for example, 3[V], 0[V]), respectively. Further, the driving voltages (Voff, Von, LCOM) thereof are generated in a polarity inverting part based on an alternating signal FR output from the timing signal generating circuit 200.

The clock generating circuit 170 generates 2 types of clocks CK1, CK2, which are different in its frequency from each other, that are synchronized with the vertical synchronous signal Vs which is the external signal. The frequency ratio of the clocks CK1 and CK2 defines the weight (length) concerning the first subfield group and the weight concerning the second subfield group. In this exemplary embodiment, the frequency of the first clock CK1 is set up as two times the frequency of the second clock CK2. Further, the total of the first subfield group corresponds to a period of the first clock CK1, in contrast the total of the second subfield group corresponds to 4×k period of the second clock CK2. Accordingly, as is described below, the total weight of the second subfield group becomes larger than the total weight of the first subfield group, and is set up as 8 times, in this exemplary embodiment.

The clock selection circuit 180 selects any one of the two clocks CK1, CK2 based on the first selection signal SEL1 and outputs it as a base clock CK3 to the gradation-signal generating circuit 160. In more detail, in a case where the selection signal SEL1 is an H level, the first clock CK1 of high frequency is selected as a base clock CK3. Meanwhile, in a case where the selection signal SEL1 is a L level, the second clock CK2 of lower level than the first clock CK1 is selected as a base clock CK3.

A level state of the first selection signal SEL1 varies with an operational mode. In a case that the first operational mode is instructed by the mode signal MODE, the first selection signal SEL1 is changed to a L level after only the first half of the period of time t1 in a 1 frame is set up as a H level, and the L level is maintained only during the period of time t1. Accordingly, the base clock CK3 corresponds to the first clock CK1 of high frequency during the first half of the period of time t1, and corresponding to the second clock CK2 of low frequency during the second half of the period of time t2. When the second operational mode is instructed, the first selection signal SEL1 is maintained as an L level. Accordingly, in this case, the base clock CK3 corresponds to the second clock CK2 of low frequency. In such a manner, the gradation-signal generating circuit 160 generates 3 gradation signals P0 to P2 defining each of the subfield SF based on the generated base clock CK3.

Figure 2:
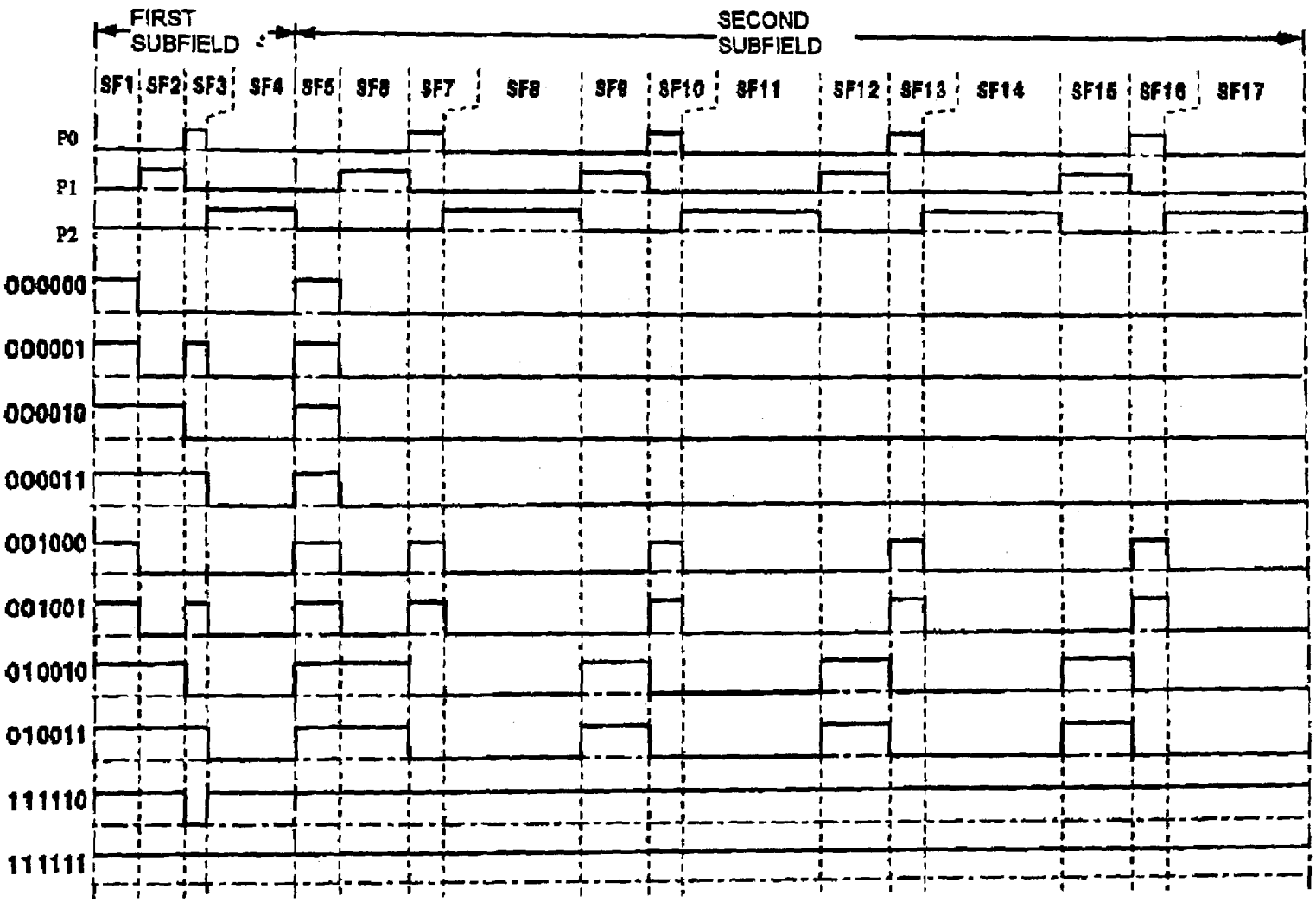
FIG. 2 is a table illustrating a subfield driving at a first operational mode.

The scheme of the driving of the subfield of a first operational mode is briefly explained below with reference to FIG. 2. Further, the setting up of weight of each of the subfields SF, the division number, or the proper combination method corresponding to the gradation data, as shown in the same drawing, is illustrated just as an example, but the present invention is not limited to these. One frame (1 F), which is a display unit of 1 picture, is divided into 17 subfields (SF) to display 64 gradations in the first operational mode. The first half of subfields SF1 to SF4 are called "the first subfield group", and the second half of subfields SF5 to SG17 are called "the second subfield group". The ratio of weight (display internal) between the first subfield group and the second subfield group is basically set up as 1:8. However, this weight ratio, however, may be properly controlled considering characteristics of the liquid crystal, such as 1:8.1, for example.

Regarding the first subfield group, the weight ratio of 3 subfields SF2 to SF4 is basically set up as 2:1:4. However, the weight of subfields SF2 to SF4 may properly be controlled within the range of about 20% (for example, 2.1:0.9:4.1) after considering characteristics of the liquid crystal. The display state (on-state/off-state) of the pixel 110 in the subfield SF2 to SF4 is determined in response to the gradation data D0 to D2 of lower 3 bits. In FIG. 2, the subfield SF3 is set up as an on-state when D0 is "1", the subfield SF2 is set up as an on-state when D1 is "1", and the subfield SF4 is set up as an on-state when D2 is "1", respectively.

Meanwhile, regarding the second subfield group having 8 times weight compared with the first subfield group, a weight ratio of the subfields SF (3*n*) to SF (3*n*+2) (n=2, 3, 4, 5) is basically set up as 2:1:4 like the subfields SF2 to SF4. For example, the ratio (SF6:SF7:SF8) of the subfields SF6 to SF8 of an n=2 group is 2:1:4. All the weights of the subfield SF (3*n*) (that is, SF6, SF9, SF12, SF15) are practically identical and accordingly are set up as lengths having two times weight of the subfield SF2 (four times weight of the shortest subfield SF3). All the weights of the subfield SF (3*n*+1) (that is, SF7, SF10, SF13, SF16) are practically identical and accordingly are set up as lengths having two times weight of the shortest subfield SF3. All the weights of the subfield SF (3*n*+2) (that is, SF8, SF11, SF14, SF17) are practically identical and are set up as periods having two times weight of the subfield SF4 (eight times weight of the shortest subfield SF3). Further, the weight of each of the subfields SF (3*n*) to SF (3*n*+2) may properly be controlled, within the range of about 20% for example, after considering characteristics of a liquid crystal (for example, 2.1:0.9:4.1). Further, for the same reason, groups whose remaining becomes identical when numbering of subfields is divided by 3 (for example, SF6, SF9, SF12 and SF15 of the remaining=0) may be controlled in its weight.

Hereinafter, a subfield SF that sets up a display state of the pixel 110 as an on-state, that is, that applies a voltage for driving the pixel 110 is called "on-subfield SFon" when any gradational display is performed. Further, a subfield SF that sets up a display state of the pixel 110 as an off-state, that is, that applies a voltage for not driving the pixel 110 is called "off-subfield SFoff".

Regarding the subfields SF (3*n*) to SF (3*n*+2) forming the second subfield group, a driving state of the pixel 110 is determined by the gradation data D3 to D5 of the high-order 3 bits. Regarding the subfields SF having the same remaining, a driving state of the pixel 110 is necessarily set up as being identical. For example, in a case that the subfield SF6 is set up as an on-subfield SFon, the subfields SF9, SF12, SF15 having the same remaining system (that is, the remaining=0 system) as SF6 are also set up as an on-subfield SFon. Further, in a case where the subfield SF7 is set up as an on-subfield SFon, the subfields SF10, SF13, SF16 having the remaining=1 system are also set up as an on-subfield SFon. The subfields SF8, SF11, SF14, SF17 having the remaining=2 system are also applied in the same manner as those described above. As a result, as shown in FIG. 2, a series of driving patterns of pixels 110 in the three subfields SF6 to SF8 are repeated four times in the whole second subfield group. For example, when the high-order 3 bits (D5D4D3) are "010", a driving pattern of the pixel 110 defined by three subfields SF6 to SF8 becomes an on•off•off, but, this driving pattern (on•off•off) is similarly repeated even in the subfields SF9 to SF11, SF12 to SF14, SF15 to SF17. Such repetition results from the transition pattern being repeated in the subfields SF9 to SF11, SF12 to SF14, SF15 to SF17, which represent the transition order (the order of H level being formed exclusively) of the gradation signal P0 to P2 in the three subfields SF6 to SF8.

Further, regarding the first subfield SF1 in the first subfield group and the first subfield SF5 in the second subfield group, a predetermined voltage (e.g., on-voltage) is applied to the pixel 110 to set up the pixel 110 as a predetermined state (e.g., on-state), independent of the gradation data D0 to D5. The reason that such subfields SF1, SF5 are provided is that the formation of the subfields results in forming a threshold voltage Vth at which transmission (or reflexibility) starts to be generated due to voltage-transmission characteristic (or voltage-reflexibility characteristic) in electro-optical material, such as liquid crystal. Further, in view of the enhancement of contrast characteristics, the first subfields SF1, SF5 may be set up as an off-state and the whole 1 frame may be set up as an off-state, just regarding the gradation "0". Further the subfield SF1 may also be set up as an off-state and the subfield SF5 may be set up as an on-state, respectively.

The display gradation of the pixel 110 is determined by an effective voltage corresponding to a combination of on-subfield SFon that sets up a display state of the pixel 110 as an on-state, but the combination is intentionally specified in accordance with the gradation data D0 to D5. In more detail, each of the subfields SF2 to SF4 forming the first subfield group is determined as an on-state or an off-state in accordance with the gradation data D0 to D2 of 3 bits of a low-order. For example, referring to FIG. 2, in a case where the low-order 3 bit (D2D1D0) is "001", the subfield SF3 of a weight "1" becomes an on-subfield SFon, and in a case of "010", the subfield S2 of a weight "2" becomes an on-subfield SFon.

Meanwhile, an on-state and an off-state of each of the subfields SF6 to SF17 forming the second subfield group are determined in accordance with the high-order 3 bit data D3 to D5. The transition-state of the gradation signals P0 to P2 in the subfields SF6 to SF8 is exclusively at an H level in the order of P1, P0, P2. This transition pattern is repeated four times in the whole second subfield group. Accordingly, for example, in a case where the high-order 3 bits (D5D4D3) are "001", the gradation signal P0 becomes an H level four times, thereby the subfields SF7, SF10, SF13, SF16 having a remaining=1 system become an on-subfield SFon. In this case, the driving pattern of the subfields SF6 to SF8 becomes "off•on•off". The driving pattern "off•on•off" is repeated four times in the whole second subfield group. The period of time of the on-state that occupies in the whole second subfield group becomes "8" (4 subfields portion multiplied by a weight "2"). Further, for example, in a case of "010", the gradation signal P1 is at an H level four times, thereby the subfields SF6, SF9, SF12, SF15 of the remaining=0 system become an on-subfield SFon. In this case, the driving pattern "on•off•off" is repeated four times in the whole second subfield group.

One main feature of this subfield driving is in that the second subfield group is divided into a plurality of groups (n=2, 3, 4, 5) and a driving pattern (e.g., "off•on•off") of one group (e.g., the subfields SF6 to SF8 of n=2) is repeated several times during a predetermined period of time. A series of driving patterns of the pixel 110 in a series of three subfields SF6 to SF8 is repeated several times thereby a desired gradation is displayed. The repetition number of the driving patterns corresponds to the repetition number (four times in this exemplary embodiment) of the transition patterns of gradation signals P0 to P2 in the three subfields SF6 to SF8. By doing so, since the on-subfield SFon is dispersed in the second subfield group, the term is almost averaged in that a display state of the pixel 110 is maintained as an on-state over the whole period of time of the second subfield group. Deterioration in gradation characteristics still remains as described previously when the on-subfield SFon is partially biased, but the on-subfield SFon is divided in a plurality of divisions and dispersed in these subfield driving thereby controlling such a bias. As a result, gradation characteristics may be enhanced thereby enhancing quality in display.

Further, another feature of these subfield driving of the present invention is in that gradation data are two times written in the pixel 110 thereby subfield driving is performed two times continuously, in a 1 frame. In more detail, regarding the first subfield group, the low-order 3 bit data D0 to D2 are written in the pixel 110 in the first subfield SF1 and then the driving of the pixel 110 corresponding to data D0 to D2 is performed in the following subfield group SF2 to SF4. Next, regarding the second subfield group, the high-order 3 bit data D3 to D5 are written in the pixel 110 in the first subfield SF5 and then the driving of the pixel 110 corresponding to data D3 to D5 is performed in the following subfield SF6 to SF17. Basically, since the effective voltage that is applied to a liquid crystal depends on the accumulative length (display term) of the on-subfield SFon occupying in the whole 1 frame, gradation becomes as much larger as the length is increased (in a case of normal black mode). In this exemplary embodiment, an on-state/off-state of the subfields SF2 to SF4 is set up during the first half of the period of time t1 of a 1 frame, based on the low-order 3 bit data D0 to D2. An on-state/off-state of the subfields SF6 to SF17 is set up during the second half of the period of time t2 of a 1 frame, based on the high-order 3 bit data D3 to D5. By doing so, 64-gradation display is implemented during the whole period of time (t1+t2) of 1 frame in accordance with gradation data D0 to D5 of 6 bits.

Figure 3:
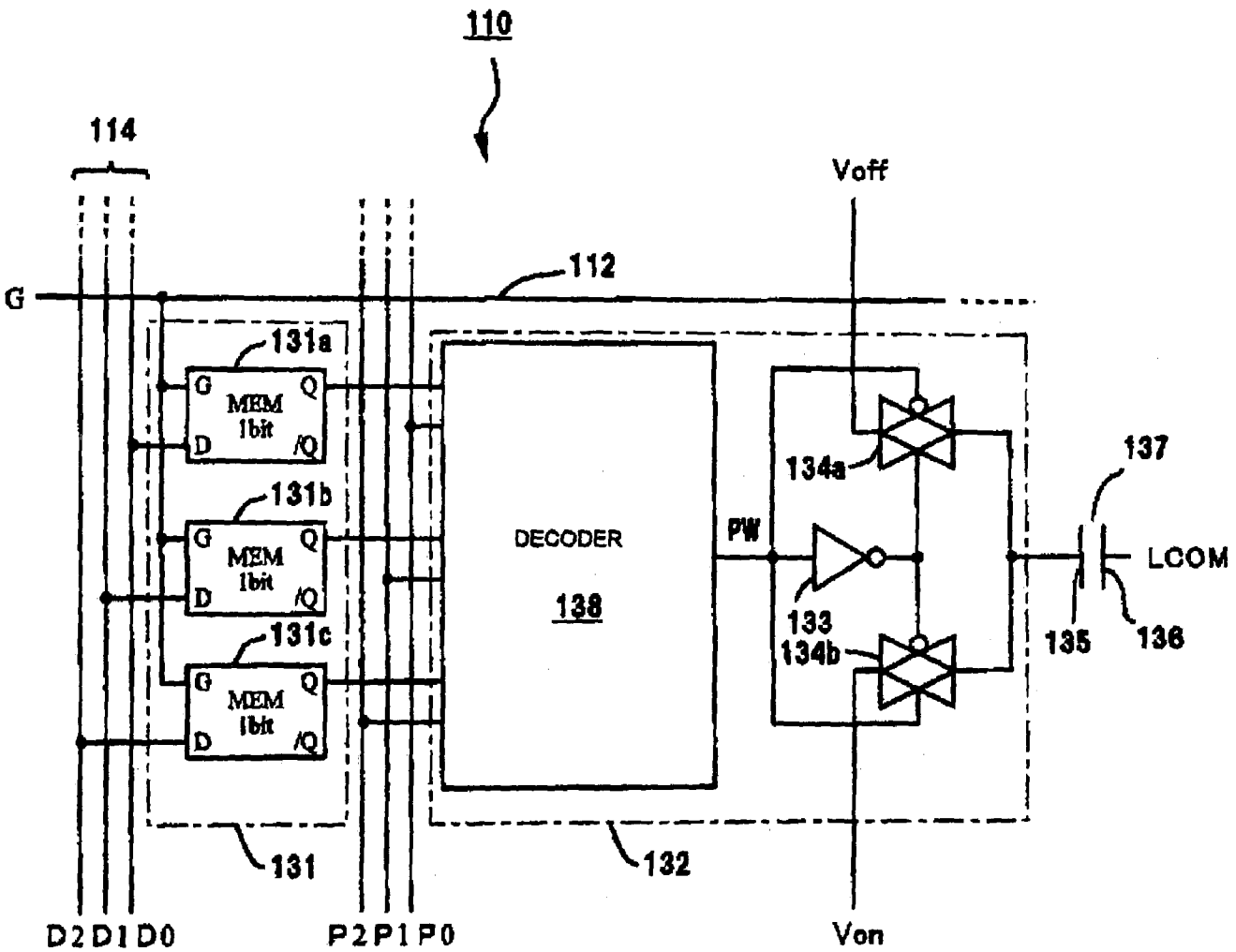
FIG. 3 is a schematic showing a structure of a pixel provided therein with a memory.

A detailed structure of the pixel 110 is explained below. FIG. 3 is a circuit view showing a configuration of the pixel 110 provided therein with memories according to this exemplary embodiment. The pixel 110, which is a basic unit of a picture, includes a memory 131, a pulse width control circuit 132, and a liquid crystal 137, which is an electro-optical device. The memory 131 includes three memory cells 131*a* to 131*c* each of which has a memory capacity of 1 bit to thereby store 3 bit data. Each of the memory cells 131*a* to 131*c* stores "1" or "0" of data signal d ("d" designates any one of data signals d1, d2, d3, . . . and dn) supplied via the data line 114. Further, one data line 114 as shown in FIG. 1 is formed with tree divisional data lines 114 and supplied with the 3 bit data as a data signal d, respectively.

Figure 4:
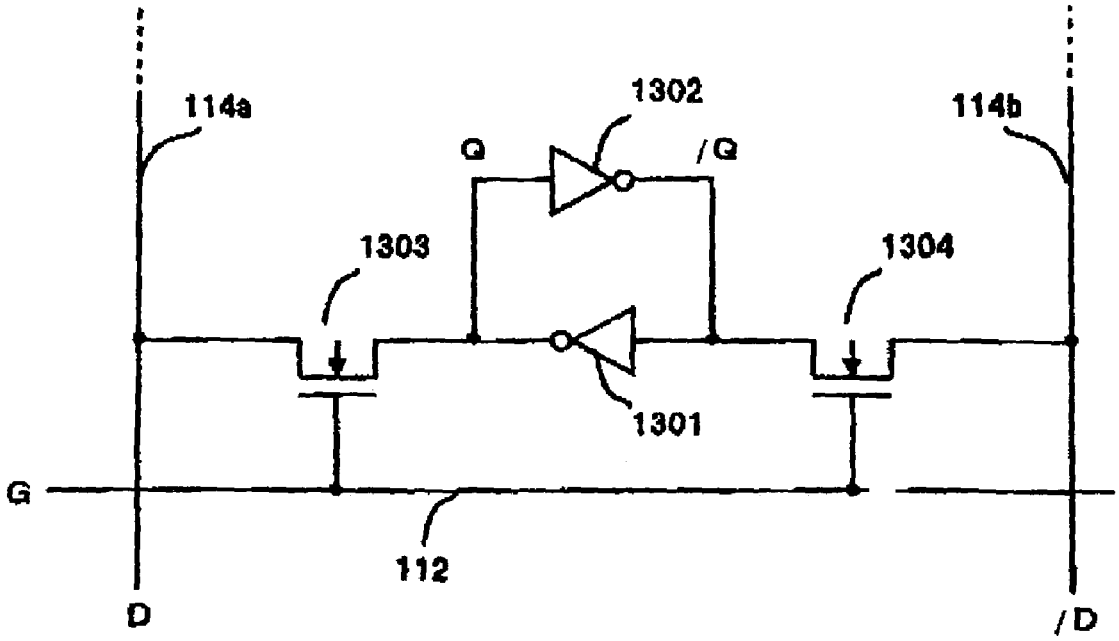
FIG. 4 is a schematic showing a structure of a memory cell.

Further, as shown in FIG. 4, one divisional data line 114 includes two data lines 114*a*, 114*b*. The one data line 114*a* is supplied with a data signal d and the other data line 114*b* is supplied with an inversion data signal /d obtained by inverting a level of the data signal d. The pulse width control circuit 132 comprises a decoder 138, an inverter 133, and a pair of transmission gate 134*a*, 134*b*. The pulse width control circuit 132 generates a pulse signal PW having a time density corresponding to gradation data D0 to D2 (or, D3 to D5), based on the gradation data D0 to D2 (or D3 to D5) and the gradation signal P0 to P2 written in the memory 131. And, a voltage having a time density corresponding to the pulse signal PW is applied to a pixel electrode 135.

FIG. 4 is a circuit view of a memory cell. The memory cell includes a static memory SRAM having a pair of inverters 1301, 1302, and a pair of transistors 1303, 1304. The inverters 1301, 1302 have a flip-flop structure with one output terminal connected to another input terminal from one another to thereby store data of a 1 bit. Each of the transistors 1303, 1304 that functions as a switching device is an N channel transistor that is at an on-state when data is read or written. A drain of one transistor 1303 is connected to a terminal (Q output) to which an input of the inverter 1301 and an output of the inverter 1302 are supplied, and a source (D input) thereof is connected to the data line 114*a*. Further, a drain of the other transistor 1304 is connected to a terminal (/Q terminal) to which an output of the inverter 1301 and an input of the inverter 1302 are supplied and a source (/D input) thereof is connected to the data line 114*b*. Gates (G input) of these transistors 1303, 1304 are commonly connected to the scanning line 112.

In this structure, when a scanning signal G ("G" designates any one of the scanning signals G1, G2, G3, . . . and Gm) of the scanning line 112 is at an H level, the transistors 1303, 1304 all become an on-state. Thereby, the data signals d, /d supplied from the data lines 114*a*, 114*b* are stored in a memory device including a pair of inverters 1301, 1302. The stored data signal d is maintained even after the scanning signal G becomes an L level and the transistors 1303, 1304 all become an off-state. Under the control by such scanning signals G, the data signal d of 1 bit stored in the memory cell 110*a* may be changed if necessary.

As shown in FIG. 3, the decoder 138 forming a part of the pulse width control circuit 132 is input with Q output of 3 bits from each of the memory cell 131*a* to 131*c*, and 3 gradation signals P0 to P2 output from the gradation-signal generating circuit 160. The decoder 138 performs a logic operation in response to the above inputs and outputs a pulse signal PW as a result of the operation. The pulse signal PW is a signal having a duty ratio (time density) corresponding to the gradation data D0 to D2 written in the memory 131 within 1 frame. FIG. 5 is a truth table of a pulse signal PW output from the decoder 138, relative to inputs of the 3 bits data (D0 to D2 or D3 to D5) and the gradation signals P0 to P2. For example, in a case where the 3 bit data (D2D1D0 or D5D4D3) is "011" and the gradation signal (P0P1P2) is "001 (LLH)", the pulse signal PW becomes "0" i.e., an L level.

An output terminal of a pair of transmission gates 134*a*, 134*b* that are provided at the rear stage of the decoder 138 are connected to the pixel electrode 135. A liquid crystal 137 is provided between the pixel electrode 135 and the counter electrode 136 to thereby form a liquid crystal layer.

The counter electrode 136 is a transmission electrode formed on one surface of the counter substrate to face the pixel electrode 135 formed on an element substrate. The counter electrode 136 is supplied with a driving voltage LCOM as described above.

The pulse signal PW that is output from the decoder 138 is supplied to a gate of P channel transistor forming a part of transmission gate 134*a* at one side and a gate of N channel transistor forming a part of the transmission gate 134*b* at the other side. Further, the pulse signal PW is applied to the gate of the N channel transistor in one transmission gate 134*a* after inverting the level by inverter 133, and the gate of the P channel transistor in the other transmission gate 134*b*. Each of the transmission gates 134*a*, 134*b* becomes an on-state in a case where a gate signal of an L level is provided to the P channel transistor and a gate signal of an H level is provided to the N channel transistor. Accordingly, any one of the pair of the transmission gates 134*a*, 134*b* alternatively becomes an on-state in accordance with the level of the pulse signal PW. Further, an input terminal of one transmission gate 134*a* is supplied with an off-voltage Voff, and an input terminal of the other transmission gate 134*b* is supplied with an on-voltage Von.

(First Operational Mode)

At the first operational mode, data are written two times in a 1 frame. A driving of one pixel 110 corresponding to the first subfield group and a driving of pixel 110 corresponding to the second subfield group are continuously performed in a 1 frame. In the case that the driving of the first subfield group is performed, the gradation data D0 to D2 of low-order 3 bits are written in the memory 131 of all of the pixel 110, in the first subfield SF1 as shown in FIG. 6*a*. In more detail, the scanning-line driving circuit 130 performs a sequential line scanning by which the scanning lines 112 are selected one at a time, in the subfield SF1. The data-line driving circuit 140 cooperates with the scanning-line driving circuit 130 and provides gradation data D0 to D2 for one pixel row to a pixel row corresponding to the selected scanning line 112 via the data line 114 while any scanning line 112 is selected. A G input of the memory cells 131*a* to 131*c* is at a H level by a selection of the scanning line 112 regarding the pixel 110 of one row portion to be written. Accordingly, regarding the pixel 110 to be written corresponding to each of the intersections between the selected scanning line 112 and the data line 114, the gradation data D0 to D2 are written in the memory 131. The gradation data D0 to D2 that are written in the memory 131 are maintained even after the selection of the scanning line 112 is completed. As described above, the first subfield SF 1 that writes data necessarily becomes an on-state, but the on-state/off-state of the subfields SF2 to SF4 that follow the subfield SF1 is determined depending on the gradation data D0 to D2 written in the memory 131.

Figure 6:
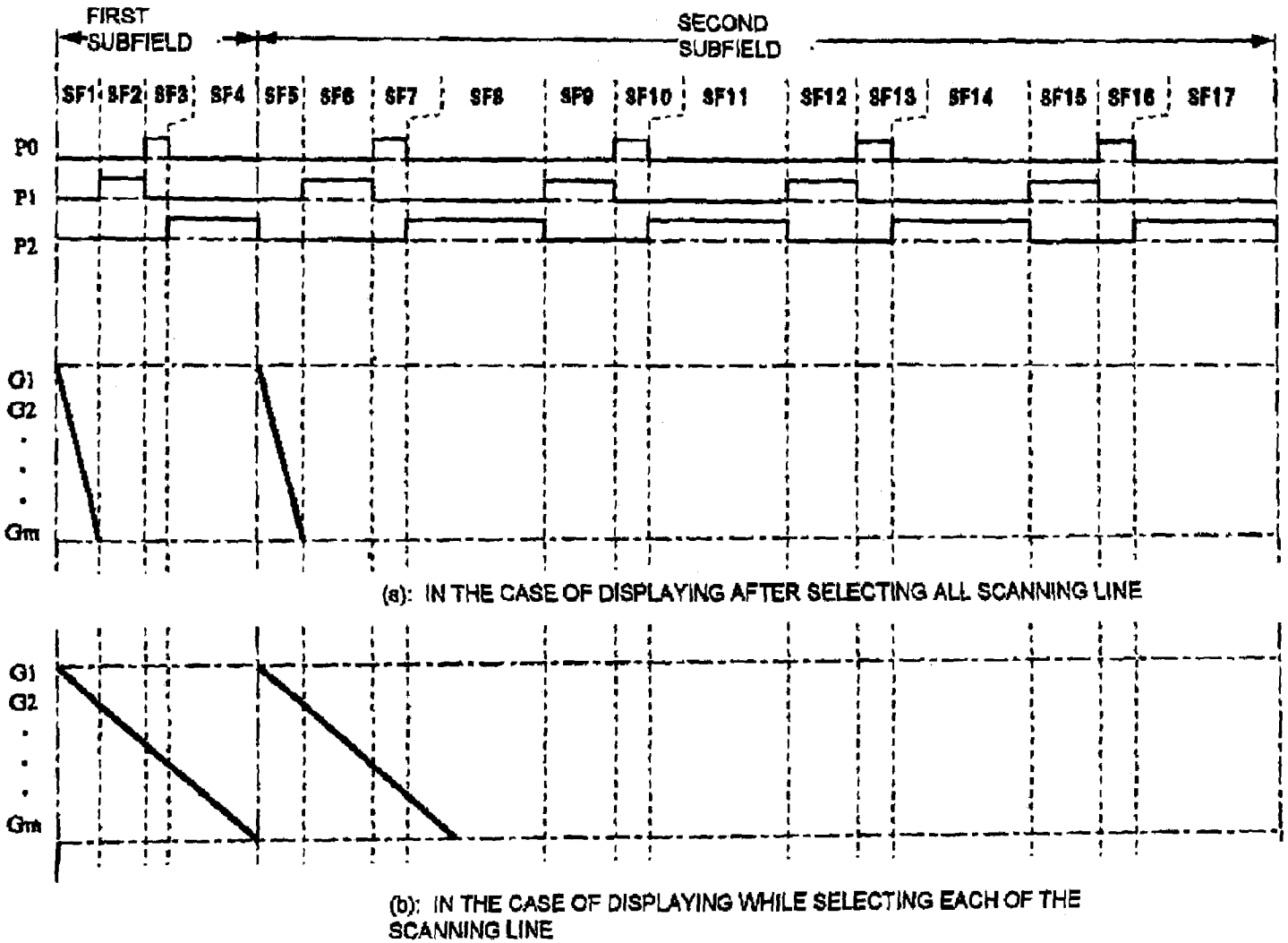
FIGS. 6(*a*) and 6(*b*) are tables illustrating a scanning timing at a first operational mode.

In a case where driving of the second subfield group is performed, the gradation data D3 to D5 of high-order 3 bits are written in the memory 131 in all the pixels 110 regarding the first subfield SF5. That is, as shown in FIG. 6(*a*), the scanning-line driving circuit 130 performs a sequential line scanning as described above, regarding the first subfield SF5, and the data-line driving circuit 140 cooperates with the scanning-line driving circuit 130 and provides the gradation data D3 to D5 for 1 pixel row portion to the pixel row corresponding to the selected scanning line 112. The gradation data D3 to D5 supplied via the data line 114 are written in the memory 131 and maintained even after the selection of the scanning line 112 is completed.

By doing so, the stored content in the memory 131 may be changed from the gradation data D0 to D2 of the low-order 3 bits to the gradation data D3 to D5 of the high-order 3 bits. The first subfield SF5 writing these data necessarily becomes an on-state, but the on-state/off-state of the following subfields SF6 to SF8 is determined depending on the gradation data D3 to D5 written in the memory 131.

If the 3 bits data (D0 to D2 or D3 to D5) are stored in the memory 131, the pulse width control circuit 132 sets up the pulse signal PW, which defines a time density, as a H level or an L level in accordance with the gradation signals P0 to P2 and the stored 3 bits data. Since the transmission gate 134*b* becomes an on-state during the period of time (on-subfield SFon) the pulse signal PW is at a H level, the pixel electrode 135 is applied with an on-voltage Von. Since the counter electrode 136 opposite to the pixel electrode 135 is applied with a driving voltage LCOM having a reverse phase of the on-voltage Von, a voltage VLCD applied to the liquid crystal 137 allows a display state of the pixel 110 to become an on-state. Since the transmission gate 134*a* becomes an on-state during the period of time (off-subfield SFoff) that the pulse signal PW is at an L level, the pixel electrode 135 is applied with an off-voltage Voff. Since the counter electrode 136 is applied with a driving voltage LCOM having the same phase as the off-voltage Voff, a voltage VLCD applied to the liquid crystal 137 allows a display state of the pixel 110 to become an off-state. Like this, the driving of the pixel 110 is performed by applying a voltage (on-voltage Von) to the pixel electrode 135 with the time density of the pulse signal PW.

As designated in the truth table in FIG. 5, in a case where the 3 bits data (the order of D2D1D0 or the order of D5D4D3. the same hereinafter) stored in the memory 131 is "000", only the gradation signal P0P1P2="000" becomes PW="1". Accordingly, the subfield SF1 (or SF5) corresponding to the gradation signal "000" becomes an on-subfield SFon, and the others except for that become an off-subfield SFoff. Next, in a case that the 3 bits data is "001", the gradation signals P0P1P2="000", "100" become PW="1". Accordingly, only the subfields SF1, SF3 (or SF5, SF7, SF10, SF13, SF16) corresponding those become an on-subfield SFon. Further, in a case that the 3 bits data is "010", the gradation signals P0P1P2="000", "010" become PW="1". Accordingly, only the subfields SF1, SF2 (or SF5, SF6, SF9, SF12, SF15) corresponding those become an on-subfield SFon. The following gradation data are applied in the same manner as described above. An on-subfield SFon where the pulse signal PW become an H level or an off-subfield SFoff where the pulse signal PW becomes an L level is determined in accordance with the 3 bits data stored in the memory 131.

The 64 gradations display at a first operational mode is implemented by writing the 3 bits data two times in the memory 131, regarding the 1 frame. At this time, while the second subfield groups are driven, the gradation signals P0 to P2 are shifted in a similar manner in four subfield groups SF6 to SF8, SF9 to SF11, SF12 to SF14, and SF15 to SF. Accordingly, the gradation data D3 to D5 stored in the memory 131 in the subfield SF5 are first read in the subfield group SF6 to SF8 and an on-state/off-state of the pixel 110 is set up in accordance with the result. Next, in the subfield group SF9 to SF11, the stored gradation data D3 to D5 are again read and an on-state/off-state is set up in the same driving pattern as in the previous subfield group SF6 to SF8. The following subfields SF12 to SF14, SF15 to SF17 are likewise applied. Like this, while the second subfield group is driven, the gradation data D3 to D5 stored in the memory 131 are read four times, and the driving pattern designating an on-state/off-state of the pixel 110 in the three subfields is repeated four times.

For example, in a case where the gradation data of 6 bits (the order of D5D4D3D2D0D0) are "010011" (gradation=19), low-order 3 bits (D2D1D0)="011" are written in the memory 131 during the first half of period of time. By doing so, the subfields SF2, SF3 corresponding to "011" are set up as an on-subfield SFon, in addition to the subfield SF1. In the following second half of period of time, the high-order 3 bits (D5D4D3)="010" is written in the memory 131. By doing so, the subfields SF6, SF9, SF12, and SF15 corresponding to "010" are set up as an on-subfield SFon, in addition to the subfield SF5. As a result, the period of time that the pixel 110 is at an on-state in a 1 frame corresponds to the total period of time of the on-subfield SFon and the gradation "19" is displayed.

(Second Operational Mode)

Figure 7:
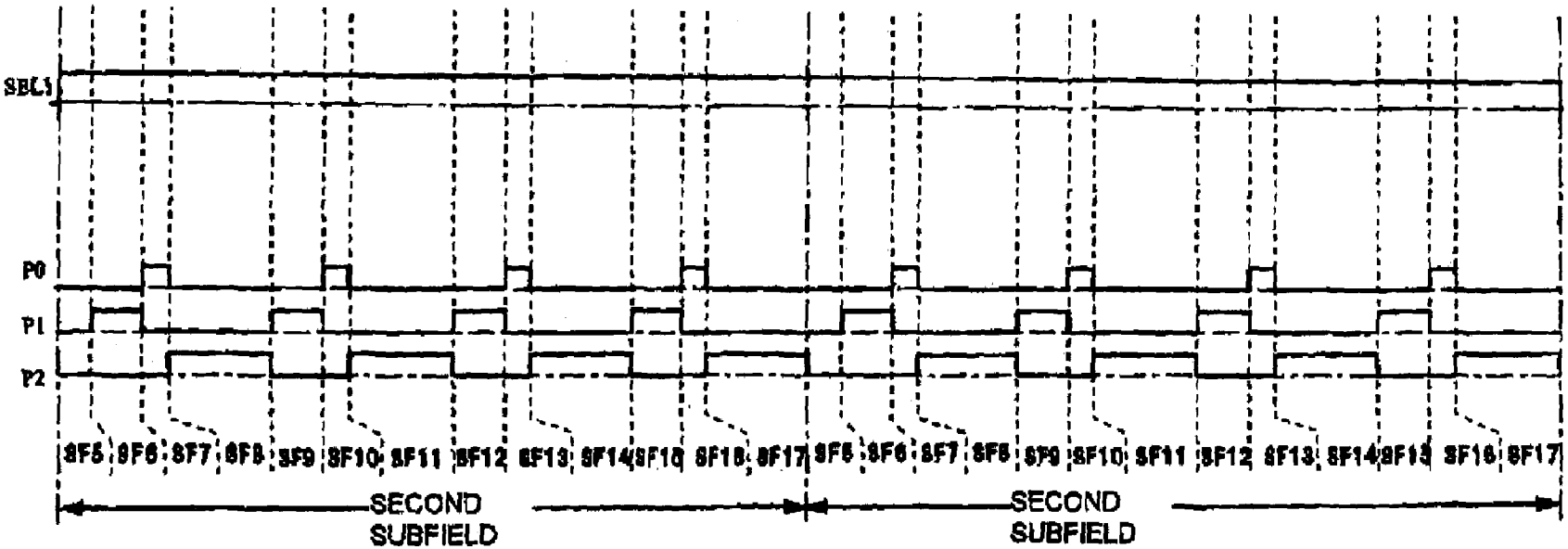
FIG. 7 is a table illustrating a subfield driving at a second operational mode.

During the second operational mode, the subfield driving for the second subfield group is continuously performed, as shown in FIG. 7. As in detail described above, in a case where the second operational mode is instructed by the mode signal MODE, the first selection signal SEL1 is an L level and the second selection signal SEL2 is an H level. Accordingly, the subfield driving for 8-gradational display is performed, thereby only the high-order 3 bits D3 to D5 as gradation data are used and only the second subfield groups are repeated.

Like the first operational mode, in the second operational mode, the gradation data D3 to D5 of high-level 3 bits are written in the memory 131 in the whole pixels 110 with respect to the first subfield SF5. The first subfield SF5 where the data are written necessarily becomes an on-state, but an on-state/off-state of the following subfield SF6 to SF17 is determined depending on the gradation data D3 to D5 written in the memory 131. In a case that a still picture is displayed, once the gradation data D3 to D5 are written in the memory 131, there is no need to again perform a data writing process if there is no need to change a display gradation of the pixel 110. Accordingly, in the subfield SF5 after the second time, writing of data by a sequentially line scanning is not performed, but the subfield driving after the second time may be performed using only 3 bits data that are read from the memory 131.

By doing so, when compared with a method by which data are repeatedly written every the subfield SF5, it serves to reduce power consumption during performing of the second operational mode. However, data such as gradation data D3 to D5 that are previously written may repeatedly be written in the memory 131 every the subfield SF5.

Further, during the second operational mode, only the first subfield group may be driven instead of driving of the second subfield group only, as is described in detail above. In this case, the pixel 110 is driven using only the low-level 3 bits data D0 to D2 after the first selection signal SEL1 is selected as an H level and the second selection signal SEL2 is selected as an L level. Further, it is possible to drive it by using both of the pair of the first and second subfield groups. In this case, the setting up itself of the subfield group is the same as in the first operational mode, but a lower-gradation display becomes possible using only gradation data of 3 bits.

Like this, according to the subfield driving of this exemplary embodiment, there is an effect to enhance gradation characteristics. The reason is that the on-subfield SFon is effectively and uniformly dispersed during the total period of time of the second subfield group. According to the exemplary embodiment, to realize this, during the driving of the second subfield group, the data D3 to D5 written in the memory 131 are repeatedly read several times, based on the gradation signal P0 to P2. A voltage having time density corresponding to these data D3 to D5 is repeatedly applied to the pixel electrode 135 several times. The number of the repetitions of the voltage applications corresponds to the number of reading data from the memory 131, that is, the repetition number of transition patterns of the gradation signals P0 to P2. By doing so, it is realized the driving of the first subfield group as well as the gradational display according to the gradation data D0 to D5.

Further, in view of improving gradation characteristics, the order of the transition of the gradation signals P0 to P2 may properly be changed in each of the repeated driving patterns. For example, in the second subfield group, in a case where the subfields SF6 to SF8 are shifted to an H level in the order of P2, P1, P3, it is the same that the following subfields SF9 to SF11 are shifted to an H level in the order of P1, P3, P2. By doing so, since the order of the gradation data D3 to D5 written in the memory 131 being read is changed, the on•subfield SFon is dispersed furthermore in the total second subfield group.

Further, according to this exemplary embodiment, the different bit columns constructing a part of the gradation data D0 to D5 are determined as a write unit and the data D0 to D2 (or D3 to D5) as the write unit are two times written in the memory 131 within a 1 frame. And, the subfield driving based on the data D0 to D2 (or D3 to D5) as the write unit is two times performed within 1 frame. Thereby, it is possible to display further multiple gradations without an increase in memory capacity of the memory 131, compared with the case where data are written only one time every 1 frame.

Further, in the exemplary embodiment as is described in detail above, an example is explained where the number of writing gradation data in a 1 frame is limited to 2 and the subfield driving is performed two times. However, it is also possible to perform the subfield driving three times or more by writing data 3 times or more in a 1 frame. In this case, a subfield group after the following third subfield group is added in addition to the first and second subfield groups as described above. For example, it is the same that the 64 gradations display is performed by writing three times of (D0, D1) and (D2, D3) and (D4, D5) or, the 512 gradations display is performed by writing three times of (D0 to D2) and (D3 to D5) and (D6 to D8).

Further, according to the exemplary embodiment, the first operational mode and the second operational mode are set up as a changeable mode, and these modes are changed in accordance with characteristics in these display content. For example, in a case where a multi-gradational moving picture is displayed, the first operational mode is selected. In a case, a still picture of a low gradation like a character is displayed, it is like that the second operational mode is selected because low power consumption is prior to the number of display gradations. By doing so, it is possible to perform a display control pertinent to display content, and it can cope with an improvement in display quality and low power consumption.

Further, according to the exemplary embodiment as described above, prior to setting up of an on/off-state of the subfield SF2 to SF4 (or the subfield SF6 to SF17), as shown in FIG. 6(*a*), an example where writing of gradation data D0 to D2 (or D3 to D5) is performed in the first subfield SF1 (or SF5) has been explained. However, the present invention is not limited to the exemplary embodiment, but it is possible to simultaneously perform writing of the gradation data D0 to D2 (or D3 to D5) and setting up of an on/off of the subfield SF2 to SF4 (or SF6 to SF17), as shown in FIG. 6(*b*). That is, the writing of the data in the memory 131 may be performed over a plurality of subfields forming a subfield group (the first subfield group or the second subfield group.

Figure 8:
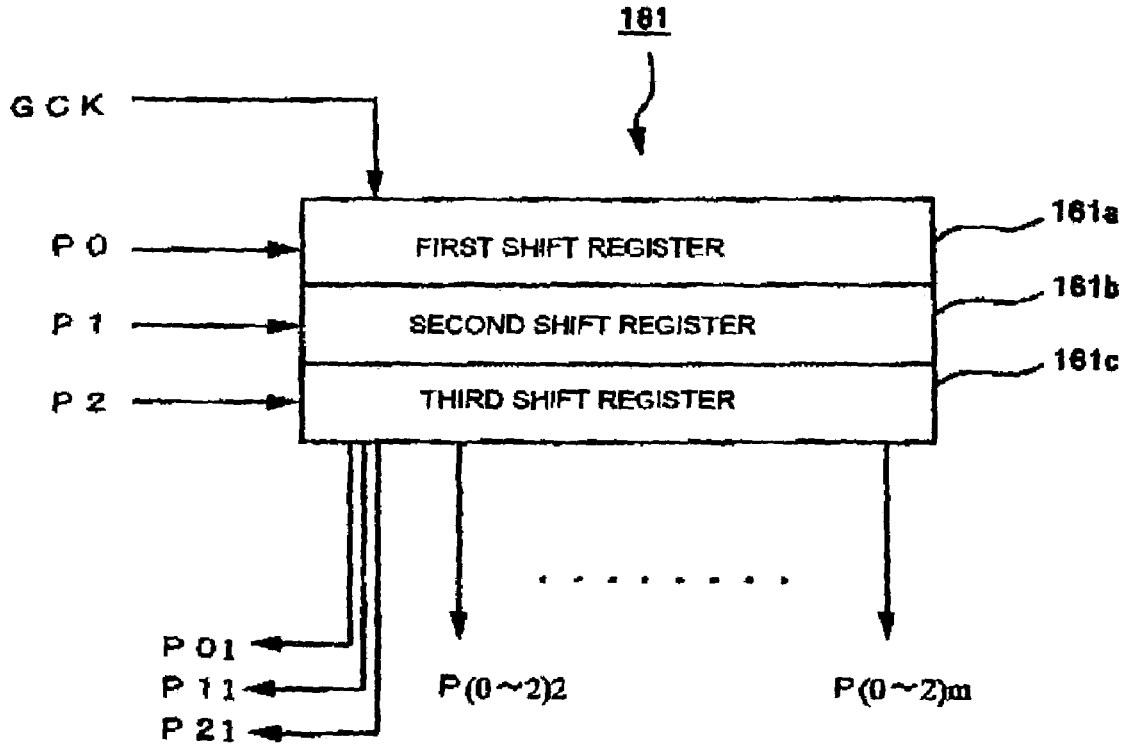
FIG. 8 is a schematic showing a structure of a gradation signal offset circuit.

In this case, the subfield driving and the data writing cannot be performed simultaneously with the gradation signal P2P1P0 having the same transition timing. To implement it, it is necessary to provide the gradation signal shift circuit 161 as shown in FIG. 8, for example, in the gradation-signal generating circuit 160. The shift circuit 161 newly generates the m shift gradation signals P (0 to 2) 1, P (0 to 2) 1, . . . and P (0 to 2)*m* where transition timing is delayed in accordance with the selection period of each of the scanning lines 112, and supplies those to pixel row corresponding to each of the scanning lines 112. That is, the subfield SF that is synchronized with each of the selected scanning line 112 is set up every the scanning lines 112. Here, P (0 to 2)*m* designates three shift gradation signal being supplied to pixel row corresponding to the $m^{th}$ scanning lines 112.

The gradation signal shift circuit 161 includes a first shift register 161*a* input with a base gradation signal P0, a second shift register 161*b* input with a base gradation signal P1, and a third shift register (161*c*) input with a base gradation signal P2. These shift register 161*a* to 161*c* are input with a clock signal GCK defining 1 horizontal scanning period of time 1H.

Figure 9:
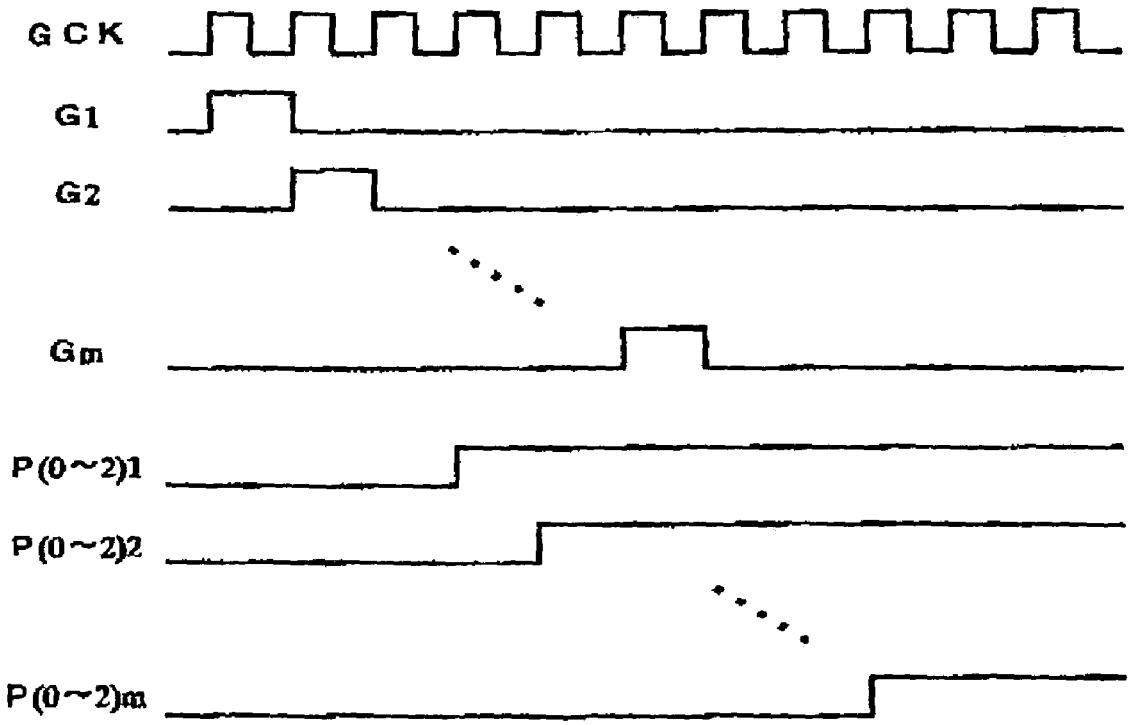
FIG. 9 is a timing chart illustrating a case where a gradation signal offset scanning and display are simultaneously performed.

FIG. 9 is a timing chart of shift gradation signals. The first shift register 161*a* transmits the base gradation signal P0 in response to the clock signal CGK, and generates the shift gradation signals P0, P02, . . . and P0*m* corresponding to each of the pixel row.

Each of the signals P01, P02, . . . and P0*m* is output to the corresponding pixel row. The second shift register 161*b* transmits the base gradation signal P1 in response to the clock signal GCK, and generates the shift gradation signals P11, P12, . . . and P1*m* corresponding to each of the pixel row. Each of the signals P11, P12, . . . and P1*m* is output to the corresponding pixel row. The third shift register 161*c* transmits the base gradation signal P2 in response to the clock signal GCK, and generates the shift gradation signals P21, P22, . . . and P2*m* corresponding to each of the pixel row. Each of the shift gradation signals P21, P22, . . . and P2*m* is output to the corresponding pixel row. By doing so, since the period of time of the subfield SF regarding the pixel row can be synchronized with the selection of the scanning lines 112 in each of the pixel rows, driving of the pixel 110 may start even during selecting of the scanning lines 112 in order.

Further, in the exemplary embodiment as is described in detail above, a liquid crystal is driven with an alternating current using a driving voltage LCOM, an off-voltage Voff with the same phase as that, and an on-voltage Von with a reverse phase of the off-voltage. However, the alternating current driving method of the liquid crystal is not limited to that, but it may naturally be possible to use other methods. For example, the counter electrode 136 of the pixel 110 is applied with a constant voltage Vc (for example, 0 [V]). Further, the pixel electrode 135 is alternatively applied with Vc or V1 (V2) in accordance with data stored in the memory 131. The voltage V1 is a high voltage as much as the voltage VH, compared with the voltage Vc, and the voltage V2 is a low voltage as much as the voltage VH compared with the voltage Vc.

Second Exemplary Embodiment

In the first exemplary embodiment as is described in detail above, subfield driving is explained by which 3 bits data as a part of gradation data are written two times in a 1 frame using the memory in the pixel of 3 bits, thereby 64 gradations display is performed. In this exemplary embodiment in a comparison with that, subfield driving is explained by which gradation data D0 to D5 of 6 bits are written at a time in a 1 frame using a pixel memory of 6 bits, thereby 64 gradations display is performed. The total structure of an electro-optical device according to this exemplary embodiment is almost the same as that shown in FIG. 1, but the following points are different. First, the data conversion circuit 300 outputs not selectively low-level 3 bits D0 to D2 and high-level 3 bits D3 to D5, but simultaneously outputs 6 bits gradation data D0 to D5. For the reason, in this exemplary embodiment, the selection signal SEL2 to instruct the selection of the gradation data Do to D2, D3 to D5 becomes unnecessary. Second, since gradation data D0 to D5 of 6 bits are supplied to the pixel 110 at a time, a supply system of the gradation data D0 to D5 is provided therein with 6 systems. Third, a memory in a pixel has a memory capacity of 6 bits. Fourth, the gradation-signal generating circuit 160 generates 6 gradation signals P0 to P5.

Figure 10:
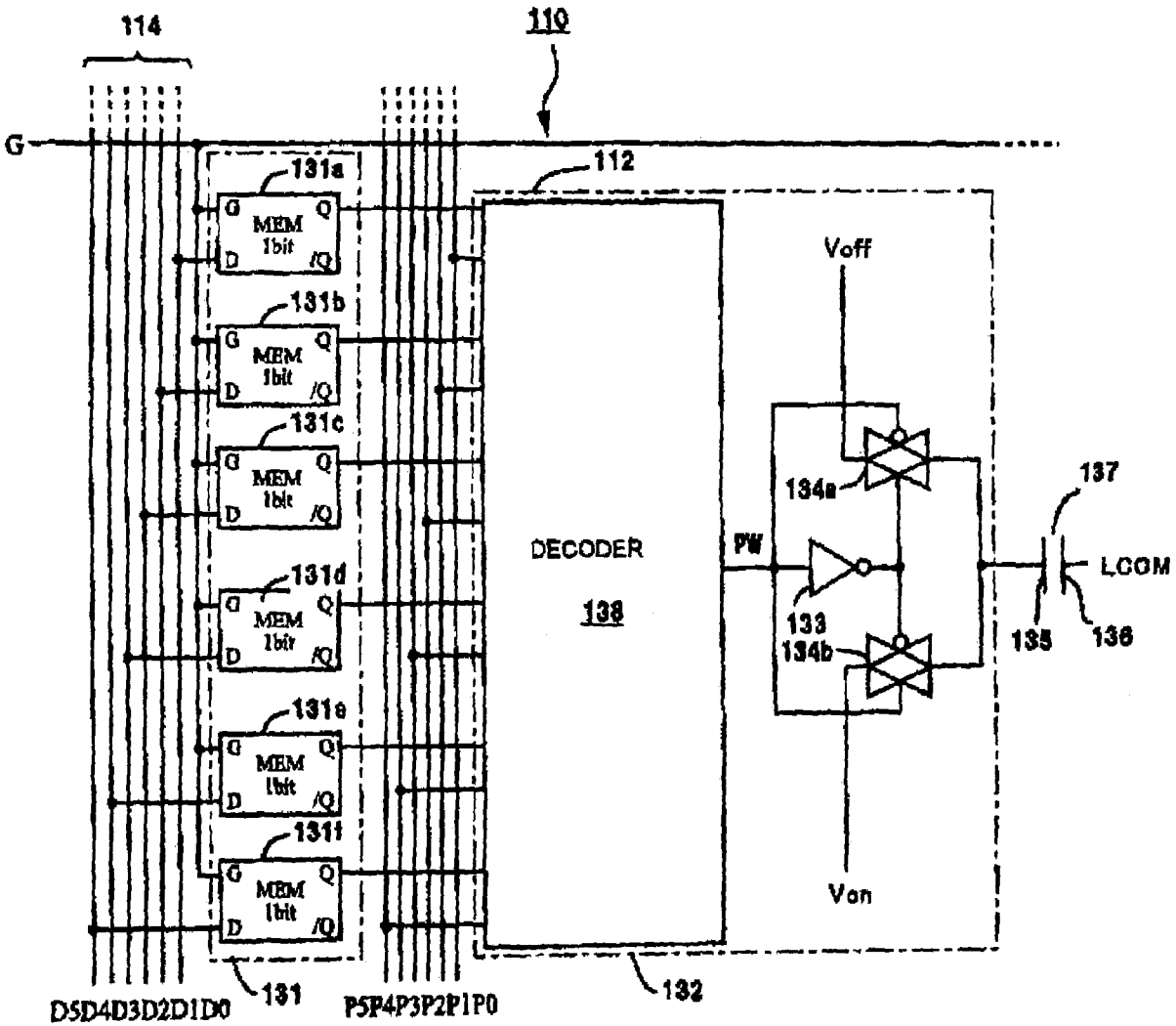
FIG. 10 is a schematic showing a structure of a pixel provided therein with a memory according to a second exemplary embodiment.

FIG. 10 is a schematic showing a structure of the pixel 110 provided therein with a memory according to this exemplary embodiment. Further, the same elements as the constituent elements shown in FIG. 3 are attached with same reference numerals, and detailed explanations thereof are omitted. In order that the memory 131 provided in each of the pixel 110 stores gradation data D0 to D5 of 6 bits simultaneously, it is constructed of 6 memory cells 131*a* to 131*f*. Further, the pulse width control circuit 132 includes a decoder 138, an inverter 133, and a pair of transmission gates 134*a*, 134*b*, like the first exemplary embodiment. However, the decoder 138 is input with an output from the 6 memory cells 131*a* to 131*d* and the 6 gradation signals P0 to P5 from the gradation-signal generating circuit 160. The decoder 138 generates the pulse signal PW having time density corresponding to the gradation data D0 to D5, based on the gradation signals P0 to P5.

Figure 11:
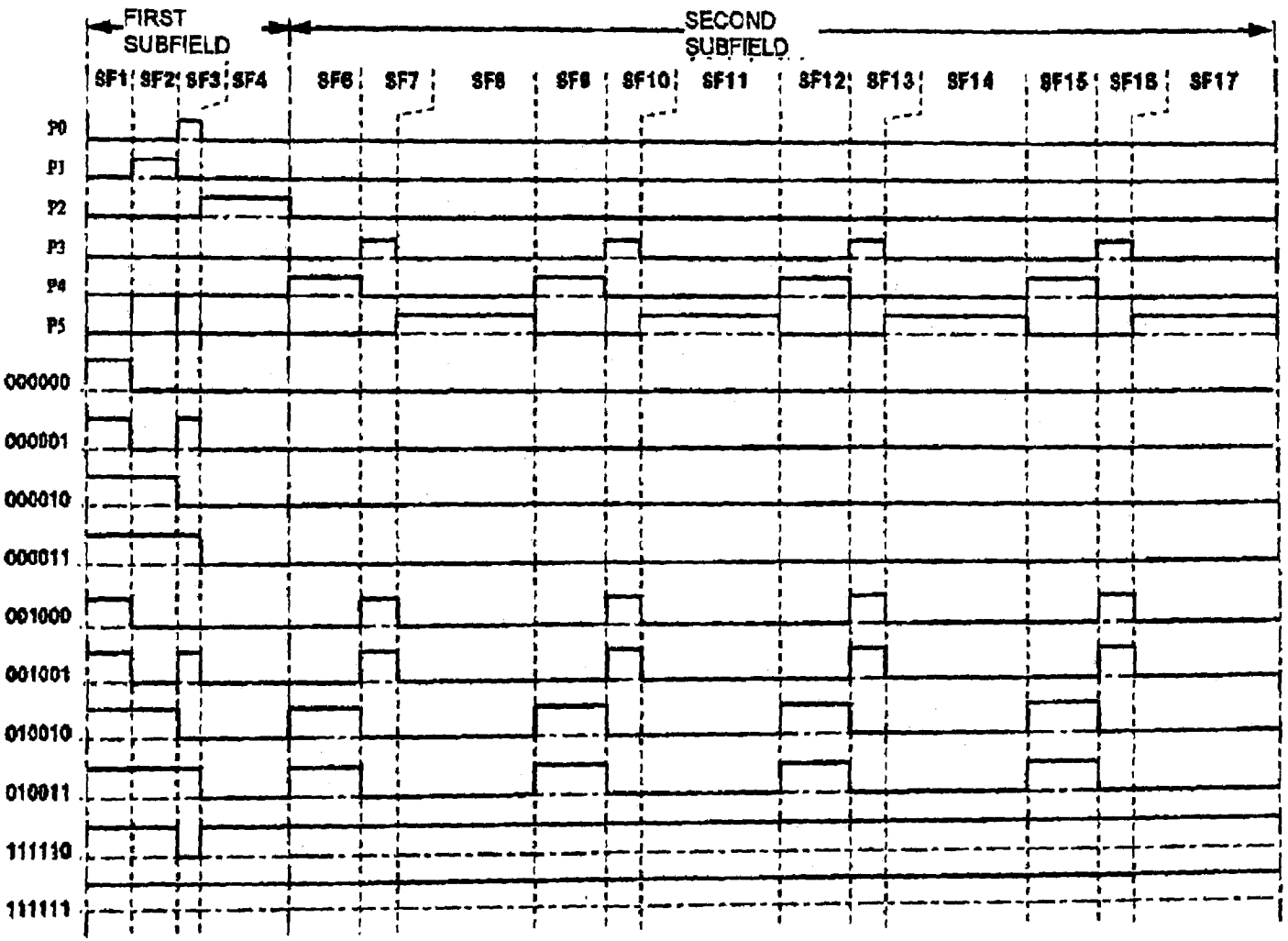
FIG. 11 is a table illustrating a subfield driving at a first operational mode according to a second exemplary embodiment.

FIG. 11 is a table explaining the subfield driving according to the first operational mode. The weight of each of the subfields or the combination method corresponding to gradation data is basically identical to the first exemplary embodiment, but it is different from the first exemplary embodiment in that there is no the subfield SF5 in the second subfield group. The reason that the subfield SF5 is not needed is that the high-level 3 bits D3 to D5 as well as the low-level 3 bits D0 to D2 are written in the memory 131 at a time in the first subfield SF1. The data written in the memory 131 at a time in the first subfield SF1 is maintained until the following gradation data D0 to D5 are written.

The gradation signals P0 to P2 become an H level in an alternative way in the subfields SF2 to SF4 forming the first subfield group, and all are maintained as an L level in the second subfield group. If several gradation signals P0, P1, P2 become an H level exclusively, any one of the subfields SF2, SF3, SF4 is assigned. The gradation signals P3 to P5 all are maintained as an L level in the first subfield group, and alternatively become an H level in the subfields SF6 to SF17 forming the second subfield group. If several gradation signals P3, P4, P5 become an H level exclusively, any one of the subfields SF (3*n*), SF (3*n*+1), SF (3*n*+2) is assigned (n=2, 3, 4, 5). The on•subfield SFon setting up a display state of the pixel 110 as an on-state is specified based on gradation data D0 to D5 and 6 bits gradation data D0 to D5 written in the memory 131.

Like this, according to this exemplary embodiment, there is an advantage in that the subfield SF5 according to the first exemplary embodiment becomes unnecessary because all the gradation data D0 to D5 are written in the subfield SF1 at a time, in addition to having an effect like the first exemplary embodiment. Further, such a simultaneously writing of the gradation data D0 to D5 may be performed not in the subfield SF1 but in the first subfield SF5 in the second subfield group. In this case, the first subfield SF1 in the first subfield group becomes unnecessary.

Further, in each of the exemplary embodiments as described above, an example is explained in which 2 values voltage (on-voltage Von, Off-voltage Voff) are alternatively applied to the pixel electrode 135, thereby the pixel 110 is set up as any one of the 2 display states (on-state or off-state). However, the present invention is not limited to the exemplary embodiments, but at least three or more voltages including an on-voltage Von and an off-voltage Voff are applied to the pixel electrode 135, thereby the driving states of the pixel 110 may be set up as 3 or more. That is, the present invention may also be applied to a driving method of applying a amplitude modulation and a subfield driving simultaneously. Further, in the detailed exemplary embodiments as described above, an example is explained in which data is to be written in a memory of a pixel in a sequentially line scanning, but the present invention is not limited to that. For example, it may be possible to perform by a dot sequential scanning or a random access.

Further, in the detailed exemplary embodiments as described above, an example is explained where a liquid crystal (LC) as an electro-optical element is used. For example, in addition to TN (Twisted Nematic) type, well known things including STN (Super Twisted Nematic) type having an orientation twisted more than 180°, BTN (Bi-stable Twisted Nematic) type, bistable type having memory characteristic of ferroelectric type and the like, polymer dispersed type, guest host type, and the like may be used as a liquid crystal. Further, the present invention may be applied to an active matrix type panel using a two-terminal switching device called TFD (Thin Film Diode) for example as well as TFT (Thin Film Transistor) as a three-terminal switching device. Further, the present invention may be applied to a passive matrix type panel in which a switching device is not used. Furthermore, the present invention may be applied to an electro-optical material except for a liquid crystal, for example, electro-luminescence (EL), digital micro miller device (DMD), or various electro-optical devices using fluorescence and the like caused by electron emission or plasma emission.

Third Exemplary Embodiment

For example, the organic EL device is used as an electro-optical device, and data writing in 2 pixels may be performed in a current programming method. The "current programming method" means a method by which data is supplied to data line based on a current. The structure of an electro-optical device according to the current exemplary embodiment is basically the same as in the first exemplary embodiment.

Figure 12:
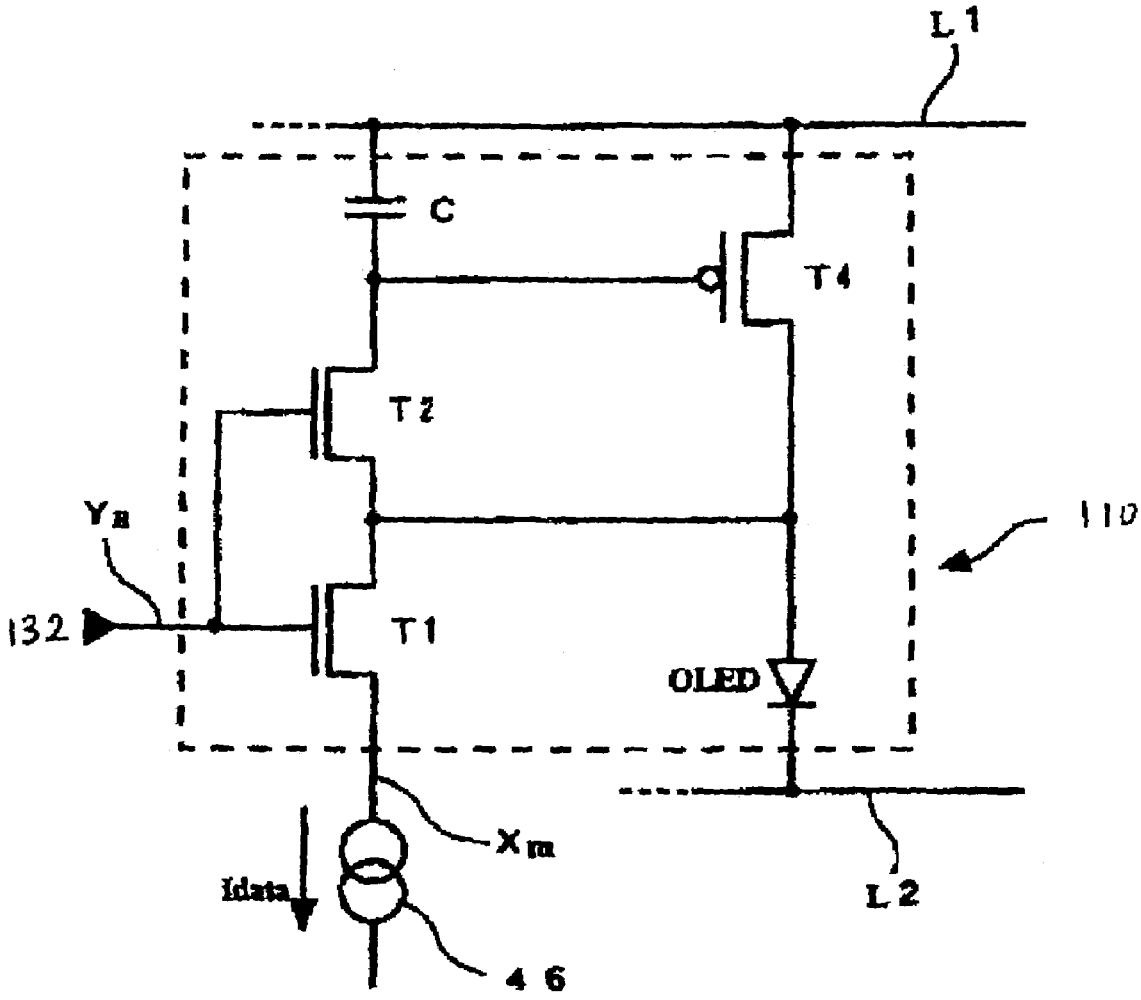
FIG. 12 is a schematic of a pixel according to a third exemplary embodiment.

FIG. 12 is a schematic showing an example of the pixel 110 using a current programming method in which an organic EL device is used according to this exemplary embodiment. One pixel 110 is constructed of an organic EL device (OLED), three transistors T1, T2, T4, and a capacitor C. A gate of the first switching transistor T1 is connected to a scanning line Yn provided with a scanning signal SEL, and its source is connected to a data line Xm provided with a data current Idata. A drain of the first switching transistor T1 is commonly connected to a source of the second switching transistor T2, a drain of the driving transistor T4, and an anode of the organic EL device OLED. A gate of the second switching transistor T2 is connected to the scanning line Yn supplied with the scanning signal SEL, like the first switching transistor T1. A drain of the second switching transistor T2 is commonly connected to one electrode of the capacitor C and a gate of the driving transistor T4. One electrode of the capacitor C and a source of the driving transistor T4 are commonly connected to a first power line L1 set up as a power voltage Vdd. Meanwhile, a cathode of the organic EL device OLED is connected to a power line L2 set up as a voltage Vss.

The control process of the pixel 110 shown in FIG. 12 is as follows. Both the switching transistors T1, T2 are turned on during the period of time that the scanning signal SEL is at an H level.

By doing so, the data line Xm and the drain of the driving transistor T4 are electrically connected. And the driving transistor T4 has a diode connection by which a self-gate and a self-drain are electrically connected to each other. The driving transistor T4 that operates even as a programming transistor allows the data current Idata supplied from the data line Xm to flow at a self channel, and generates a gate voltage Vg corresponding to the data current Idata toward the self gate. As a result, the capacitor C connected to the gate of the driving transistor T4 is stored therein with charge corresponding to the generated gate voltage Vg and written with data. Thereafter, the scanning signal SEL comes down to an L level, both the switching transistors T1, T2 are turned off. By doing so, the data line Xm and the drain of the driving transistor T4 are electrically disconnected. However, by the stored charge of the capacitor C, since the gate of the driving transistor T4 is applied with a voltage corresponding to the gate voltage Vg, the driving transistor T4 has kept a driving current corresponding to the gate current Vg flowing in the self channel. As a result, the organic EL device OLED provided in current path of the driving current emits light with brightness corresponding to the driving current, thereby gradational display of the pixel 110 is performed.

Like this, according to the current exemplary embodiment, the pixel 110 includes the organic EL device OLED, and the same effect as in each of the exemplary embodiments can be obtained even in an electro-optical device in which data are written in the pixel 110 by the current programming method.

Further, an electro-optical device having a display unit 100 (regardless of distinction between a projection type and a mirror type) being capable of displaying gradation in high quality may be provided in various electronic apparatus, for example, including a projector, a portable telephone, a portable terminal, a mobile computer, a personal computer, and the like, for example. If the electro-optical device is provided in such an electronic apparatus, the value of goods of the electronic apparatus can be furthermore enhanced and accordingly it can enhance the appealing power of goods of the electronic apparatus in the market.

EXEMPLARY ADVANTAGES

According to the present invention, gradational data stored in a memory of a pixel are repeatedly read several times, and the pixel is repeatedly applied with a voltage having time density corresponding the read data several times, thereby gradational display in accordance with gradation data is performed. By doing so, in a predetermined period of time, the period of time for driving the pixel can be dispersed almost uniformly. As a result, gradation characteristic may be enhanced, so that display quality can be enhanced furthermore.

What is claimed is:

1. A method of driving an electro-optical device that divides a predetermined period of time into a plurality of subfields, performs gradation display with a combination of subfields in accordance with gradation data, and provides memories to store gradation data that are provided in each of a plurality of pixels, the method of driving an electro-optical device comprising:

in the predetermined period of time:

first writing at least part of the gradation data in the memory provided in each of the pixels; and second performing gradational display corresponding to the gradation data by specifying a driving state of pixels in each of the subfields based on the at least part of the gradation data written in the memory and a gradation signal that defines each of the subfields, and also repeating a series of driving patterns of the pixels in a plurality of continuous subfields a plurality of times, in the second step, the order of shifting the gradation signal being changed in each of the repeated driving patterns.

2. The method of driving an electro-optical device according to claim 1, in the second step, the number of repetitions of the driving patterns corresponding to the number of repetitions of a series of transition patterns of the gradation signal in a plurality of continuous subfields.

3. A method of driving an electro-optical device that divides a predetermined period of time into a first subfield group and a second subfield group, performs gradational display with a combination of subfields corresponding to first data forming part of gradation data and second data forming part of the gradation data and differing from the first data, and provides a memory in each of pixels to store the gradation data, the method of driving an electro-optical device comprising:

in the predetermined period of time:

first writing the first data in the memory provided in each of the pixels;

second reading the first data written in the memory based on a first gradation signal defining each of the sub fields forming the first subfield group, and also applying to the pixels a voltage corresponding to the first read data;

third writing the second data in the memory; and fourth repeatedly reading the second data written in the memory a plurality of times based on a second gradation signal defining each of the subfields forming the second subfield group, and also repeatedly applying a voltage corresponding to the second read data to the pixels a plurality of times.

4. The method of driving an electro-optical device according to claim 3, in the second step, the voltage applied to the pixels having a time density corresponding to the first data read from the memory, and in the fourth step, the voltage applied to the pixels having a time density corresponding to the second data read from the memory.

5. The method of driving an electro-optical device according to claim 3, the entire weight of the second subfield group being larger than that of the first subfield group.

6. The method of driving an electro-optical device according to claim 5, the driving state of the pixels in each of the subfields forming the first subfield group being specified to correspond to lower data in the gradation data, and the driving state of the pixels in each of the subfields forming the second subfield group being specified to correspond to upper data in the gradation data.

7. A method of driving an electro-optical device that divides a predetermined period of time into a first subfield group and a second subfield group, performs gradational display with a combination of subfields corresponding to first data forming part of gradation data and second data forming part of the gradation data and differing from the first data, and provides a memory in each of a plurality of pixels for storing the gradation data, the method of driving an electro-optical device comprising:

first writing the first data in the memory provided in each of the pixels;

second reading the first data written in the memory based on a first gradation signal defining each of the subfields forming the first subfield group, and also applying a current corresponding to the first read data to the pixels;

third writing the second data in the memory; and fourth repeatedly reading the second data written in the memory based on a second gradation signal defining each of the subfields forming the second subfield group a plurality of times, and also repeatedly applying a current corresponding to the second read data to the pixels a plurality of times.

* * * * *